United States Patent [19]

Romann et al.

[11] Patent Number: 4,500,866

[45] Date of Patent: Feb. 19, 1985

[54] ELECTRIC POTENTIOMETER

[75] Inventors: Peter Romann, Stuttgart; Rudolf Sauer, Benningen; Heinrich Steinrücken, Ludwigsburg, all of Fed. Rep. of Germany

[73] Assignee: Robert Bosch GmbH, Stuttgart, Fed. Rep. of Germany

[21] Appl. No.: 488,316

[22] Filed: Apr. 25, 1983

[30] Foreign Application Priority Data

Jul. 24, 1982 [DE] Fed. Rep. of Germany ..... 3227805

[51] Int. Cl.[3] ..... H01C 10/16

[52] U.S. Cl. ..... 338/126; 338/142; 338/162; 338/190; 338/185; 338/309

[58] Field of Search ..... 338/118, 123–128, 338/138–140, 142, 162, 176, 190, 194, 202, 157, 185, 308, 309

[56] References Cited

U.S. PATENT DOCUMENTS 3,837,321 9/1974 Sauer ..... 338/142

4,139,831 2/1979 Ortlieb et al. ..... 338/188

FOREIGN PATENT DOCUMENTS 846956 9/1960 United Kingdom ..... 338/139

OTHER PUBLICATIONS

Vick, "Ideas for Designers", International Electronics, vol. 17, No. 5 (Sep.-Oct. 1970) pp. 28 and 31.

*Primary Examiner*—Roy N. Envall, Jr.

*Assistant Examiner*—C. N. Sears

*Attorney, Agent, or Firm*—Edwin E. Greigg

[57] ABSTRACT

An electric potentiometer is proposed which serves to convert a mechanical movement into an electrical value. The potentiometer includes a pickup embodied as a wiper and a resistor pad which has a plurality of connections for parallel resistors distributed over the displacement range of the pickup and serving as support points. With these parallel resistors, the partial resistance established by the pickup can be varied to a predetermined course. The support points extend crosswise to the contact track of the pickup on the resistor pad and are embodied as only so long that they terminate before reaching the contact track.

1 Claim, 3 Drawing Figures

ELECTRIC POTENTIOMETER

BACKGROUND OF THE INVENTION

The invention is based on an electric potentiometer as generally defined hereinafter. A potentiometer is already known which is disposed on an air flow rate meter and serves to regulate the fuel supply to an internal combustion engine, and in which the metal support points extend crosswise to the contact track of the pickup and over the entire width of the resistance pad. An error in the course of the output voltage occurs, because as the wiper passes over the width of the support points the voltage does not vary. Furthermore, the slight elevation in the resistance pad at each support point results in increased wear of resistance pad material at these points.

OBJECT AND SUMMARY OF THE INVENTION

The electric potentiometer according to the invention has the advantage over the prior art in that both the accuracy and the precision of the potentiometer can be increased.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
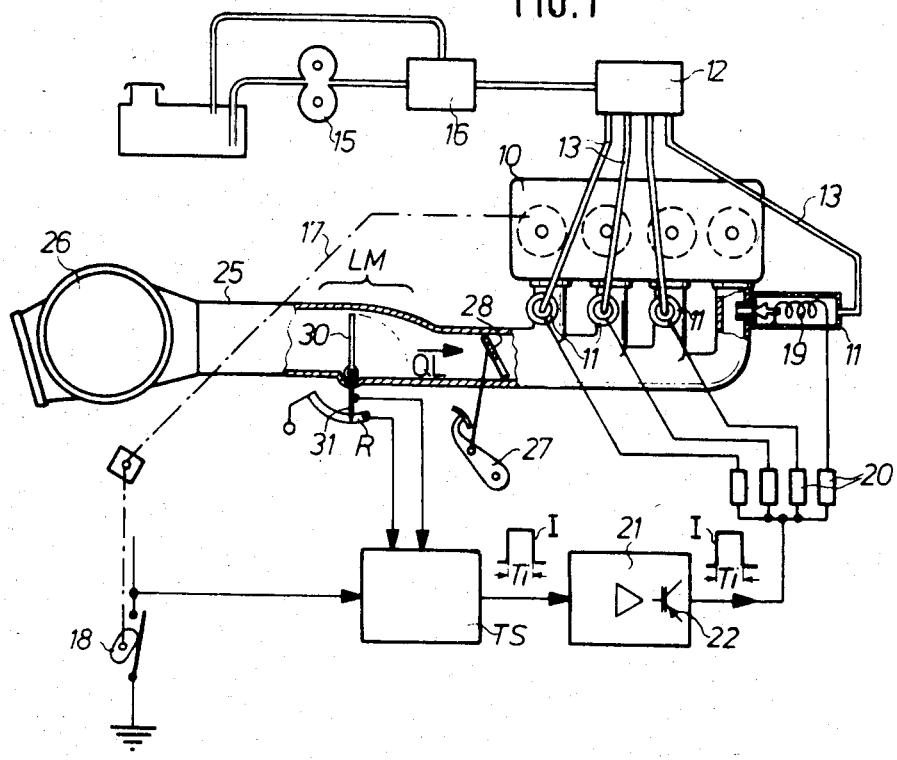
FIG. 1, in schematic form, shows an electrical fuel injection device having a potentiometer.

The injection apparatus shown by way of example in FIG. 1 is intended for the operation of a mixture-compressing four-cylinder, four-stroke internal combustion engine 10 with externally supplied ignition. As its essential components, the injection apparatus includes four electromagnetically actuatable injection valves 11, to which the fuel to be injected is supplied from a distributor 12 via respective tubular lines 13; a fuel supply pump 15 driven by an electric motor; a pressure regulator 16, which regulates the fuel pressure to a constant value; and an electronic control device, which is triggered twice during each revolution of the camshaft by means of a signal transducer 18 coupled with the camshaft 17 of the engine and each time furnishes a rectangular, electrical opening pulse I for each of the injection valves 11. The duration $T_i$ of the opening pulses indicated in the drawing determines the duration of the opening of the injection valves and accordingly determines the particular fuel quantity leaving the interior of the injection valves 11, which are under a practically constant fuel pressure of 2 atmospheres, during a given opening duration. The magnetic windings 19 of the injection valves are each connected in series with one decoupling resistor 20 and are connected to a common amplification and power stage 21, which contains at least one power transistor indicated at 22, which is disposed with its emitter-collector path in series with the decoupling resistors 20 and the magnetic windings 19, the latter being connected at one end to ground.

In mixture-compressing internal combustion engines having externally supplied ignition, of the general type shown, the quantity of fuel which can be combusted completely during a subsequent work stroke is fixed by the quantity of aspirated air reaching a cylinder in a single intake stroke. For good engine efficiency, it is furthermore necessary that there be no substantial air excess following the work stroke. In order to attain the desired stoichiometric ratio between the aspirated air and the fuel, an air flow rate meter LM is provided in the intake tube 25 of the engine, downstream of its filter 26 but upstream of its throttle valve 28 which is adjustable with a gas pedal 27. The air flow rate meter LM substantially comprises an air-flow sensor flap 30 and a variable resistor (potentiometer) R, the adjustable pickup 31 of which is coupled with the sensor flap 30. The air flow rate meter LM cooperates with a transistor switching device TS, which at its output furnishes the control pulses I for the power stage 21.

Figure 2:
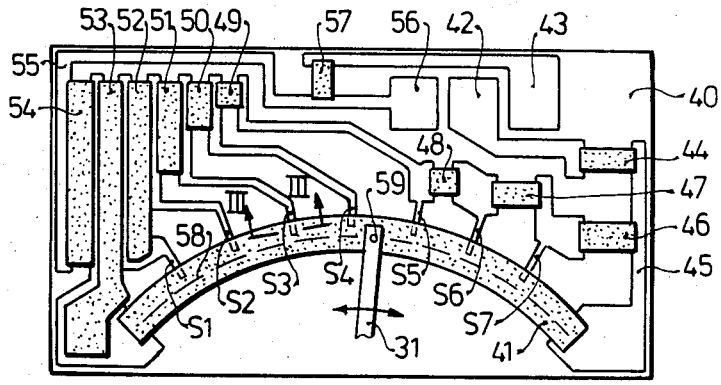
FIG. 2 shows a potentiometer embodied in accordance with the invention.

The potentiometer R shown in FIG. 2 has a carrier chip 40 of insulating material, which has a resistance pad 41 in the form of an arc and applied by thick film techniques by way of example. The pickup, embodied as a wiper 31, slides on this resistance pad 41. In order to attain the required course of the resistance values in accordance with the rotational angle of the wiper 30 or the pivot angle of the sensor flap 30, the resistor 41 is subdivided by support points S1–S7. These support points S1–S7 are of silver, by way of example, applied to the carrier chip 40 and burned in place. The electrical connection of the resistor 41 is effected via the two contact areas or fields 42 and 43. From the contact area 42, one film resistor 44 leads to the beginning of the potentiometer resistor 41 via a conductor piece 45, from which a first parallel resistor 46 branches off; this resistor 46 and all the other resistors 47–53 are each connected to one of the support points S1–S7, and in terms of its length and width, the resistor 46 and all the others can be brought by some suitable method, such as with a laser, to a prescribed resistance value, with which the potentiometer resistor 41 attains the prescribed course of resistance, which in particular is nonlinear. The resistor 53 is connected on the one hand with the support point S1 and on the other with the end of the potentiometer resistor 41; connected in series with this resistor 53 is a resistor 54, from which a conductor piece 55 leads to a contact field 56. A further resistor 57 leads to the contact field 43. The resistor 57 serves to generate a fixed partial voltage, with which the voltage applied between the field 42 and 43 can be monitored and, as required, regulated.

Figure 3:
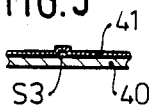
FIG. 3 is a section taken along the line III—III of FIG. 2.

Dashed lines at 58 indicate the curved course of the contact track along the resistor pad 41 of the contact 59 disposed on the pickup 31. The support points S1–S7 extending in the direction of the contact track 58 beneath the resistor pad 41 (see FIG. 3 as well) are embodied so that their respective lengths terminate, in accordance with the invention, before they reach the end of the contact track 58. The embodiment of the support points S1–S7 in accordance with the invention furthermore makes the desired variation possible, and on the one hand improves the accuracy of the variation in the vicinity of the support points S1–S7 and on the other hand prevents excessive wear of the resistor pad 41 in the vicinity of the support points S1–S7.

The invention relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An electric potentiometer comprising a pickup wiper means and a resistor pad, said resistor pad having a plurality of metallic connections for parallel resistors distributed over the displacement range of said pickup means and serving as connection support points, with which the partial resistance established by said pickup means can be varied to a predetermined nonlinear value in accordance with the displacement of the pickup, and said connection support points extending in a direction crosswise to but not extending past a contact track of said pickup means sliding along said resistor pad, said connection support points extending beneath said resistor pad and terminating thereunder a distance removed from said contact track of said pickup means.

* * * * *